US010916886B2

(12) United States Patent
Yanase

(10) Patent No.: US 10,916,886 B2
(45) Date of Patent: Feb. 9, 2021

(54) CONNECTOR FIXTURE

(71) Applicant: Kitagawa Industries Co., Ltd., Aichi (JP)

(72) Inventor: Yoshiaki Yanase, Gifu (JP)

(73) Assignee: Kitagawa Industries Co., Ltd., Aichi (JP)

( * ) Notice: Subject to any disclaimer, the term of this patent is extended or adjusted under 35 U.S.C. 154(b) by 0 days.

(21) Appl. No.: 16/661,257

(22) Filed: Oct. 23, 2019

(65) Prior Publication Data

US 2020/0194933 A1 Jun. 18, 2020

(30) Foreign Application Priority Data

Oct. 24, 2018 (JP) ..... 2018-200072

(51) Int. Cl.
*H01R 13/62* (2006.01)
*H01R 13/627* (2006.01)

(52) U.S. Cl.
CPC ..... *H01R 13/6275* (2013.01)

(58) Field of Classification Search
CPC ... H01R 43/18; H01R 13/436; H01R 43/4362
USPC ..... 439/345
See application file for complete search history.

(56) References Cited

U.S. PATENT DOCUMENTS 6,655,025 B2 * 12/2003 Kashiyama ..... H01R 13/4362 29/753
8,789,854 B2 * 7/2014 Christian, Jr. ..... F16L 37/082 285/320
10,048,447 B2 * 8/2018 Verheyden ..... G02B 6/3825
10,352,343 B2 * 7/2019 Milner ..... E04F 11/1817
2015/0351280 A1 * 12/2015 Gonzalez Inda ..... G06F 1/181 361/695

FOREIGN PATENT DOCUMENTS

JP 2005142127 A 6/2005

* cited by examiner

*Primary Examiner* — Alexander Gilman
(74) *Attorney, Agent, or Firm* — Renner, Otto, Boisselle & Sklar, LLP

(57) ABSTRACT

A connector fixture includes a fixture body and a positioning member. The fixture body includes a fixing portion, a retaining portion, and a contact portion. When the fixture body is attached to the first connector, the fixing portion determines the relative position between the fixture body and the first connector in a z-axis direction. The contact portion determines the relative position between the fixture body and the first connector in a y-axis direction. The positioning member determines the relative position between the fixture body and the first connector in an x-axis direction. The positioning member is configured to be separable from the fixture body.

4 Claims, 19 Drawing Sheets

CONNECTOR FIXTURE

CROSS-REFERENCE TO RELATED APPLICATIONS

This application claims the benefit of Japanese Patent Application No. 2018-200072 filed Oct. 24, 2018 in the Japan Patent Office, and the entire disclosure of Japanese Patent Application No. 2018-200072 is incorporated herein by reference.

BACKGROUND

The present disclosure relates to a connector fixture.

A lock claw replacing jig, which is used as an alternative when a lock claw of a modular plug (corresponding to an example of the first connector in the present disclosure) has been broken, has been proposed (see, for example, Japanese Patent Application Laid-Open No. 2005-142127). Using such lock claw replacing jig, it is possible to prevent the modular plug from slipping out of the modular jack (corresponding to an example of the second connector in the present disclosure).

However, in the lock claw replacing jig (1) described above, when the fixing plate portion (1a) is fixed to the upper surface of the plug body (3a), it is not easy to set the fixing plate portion at an optimum position on the upper surface of the plug body.

More specifically, in the above-described lock claw replacing jig, a front end of the fixing plate portion is fixed so as to abut against the base end portion (3b). Thus, the fixing plate portion can be positioned in a direction that is parallel to the plug insertion direction (corresponding to the y-axis direction in the present disclosure). However, the fixing plate portion cannot be positioned in the direction that is orthogonal to the plug insertion direction (corresponding to the x-axis direction in the present disclosure). Therefore, there is a possibility that the lock claw replacing jig is deviated from the center of the plug in the direction that is orthogonal to the plug insertion direction. In this case, if the deviation becomes large, the lock claw replacing jig may not be hooked on the structure on the modular jack side, or the locking claw replacement jig may become an obstacle, preventing the modular plug from being inserted into the modular jack.

In one aspect of the present disclosure, it is desirable to provide a connector fixture that enables an easy positioning operation for a connector when the connector fixture is fixed to the connector.

SUMMARY

One aspect of the present disclosure is a connector fixture, which includes a fixture body and a positioning member. The fixture body includes a fixing portion, a retaining portion, and a contact portion. The fixing portion is configured to be fixed to a first connector when the fixture body is attached to the first connector, and to determine relative position between the fixture body and the first connector in a z-axis direction among x-axis direction, y-axis direction, and z-axis direction, the directions being orthogonal to each other, when the fixing portion is fixed to the first connector. When said first connector is connected to a second connector in a state where the fixture body is attached to the first connector, the retaining portion is configured to be hooked on a place of a device including the second connector, preventing the first connector from being displaced and detached from the second connector. The contact portion is configured to contact the first connector when the fixture body is attached to the first connector, to determine relative position between the fixture body and the first connector in the y-axis direction. The positioning member is configured to contact the first connector when the fixture body is attached to the first connector, to determine relative position between the fixture body and the first connector in the x-axis direction. The positioning member is configured to be separable from the fixture body.

According to the connector fixture configured as described above, the fixture body can be attached to the first connector by fixing the fixing portion to the first connector. When said first connector is connected to the second connector in the state where the fixture body is attached to the first connector, the retaining portion is hooked on the place of the device including the second connector, preventing the first connector from being displaced and detached from the second connector. Therefore, use of the fixture body can prevent the first connector from being detached from the second connector.

Further, when the fixture body is attached to the first connector, the relative position between the fixture body and the first connector can be determined in the x-axis direction by the positioning member, in the y-axis direction by the contact portion, and in the z-axis direction by the fixing portion. Accordingly, as compared with the case where positioning cannot be performed in any one or more of the x-axis direction, the y-axis direction, and the z-axis direction, the fixture body can be accurately positioned and attached to the first connector.

Furthermore, the positioning member can be separated from the fixture body. For this reason, once the fixing portion is fixed to the first connector, the positioning member can be separated from the fixture body to detach the positioning member. Thus, as compared with the case where the positioning member cannot be detached, the structure attached to the first connector can be made compact. In addition, in a case where the positioning member is detached, to connect the first connector to the second connector, the positioning member does not become an obstacle. In other words, even the positioning member that would become an obstacle when the first connector is connected to the second connector unless detached may be used without any problem. Therefore, the positioning member can be disposed at any desired position without considering whether or not the positioning member becomes an obstacle when the first connector is connected to the second connector.

BRIEF DESCRIPTION OF THE DRAWINGS

The invention will be described with reference to the accompanying drawings, wherein like numbers reference like elements.

DESCRIPTION OF EMBODIMENTS

Figure 1A:
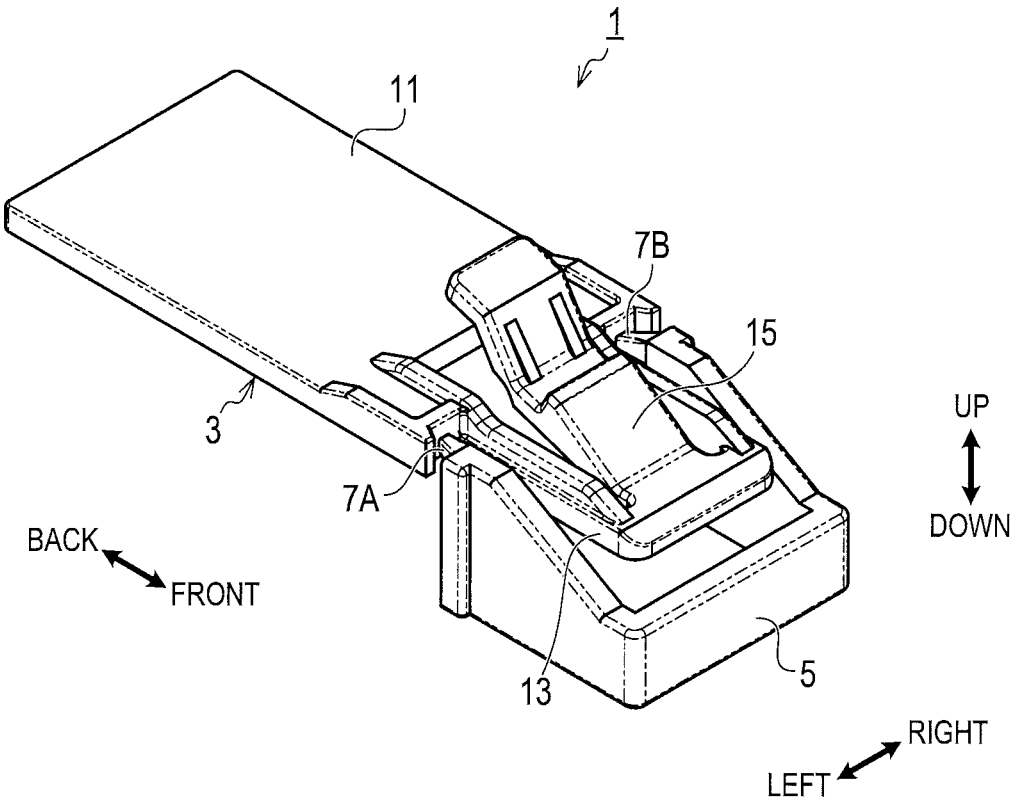
FIG. 1A is a perspective view of a connector fixture when viewed from the upper left front.
Figure 1B:
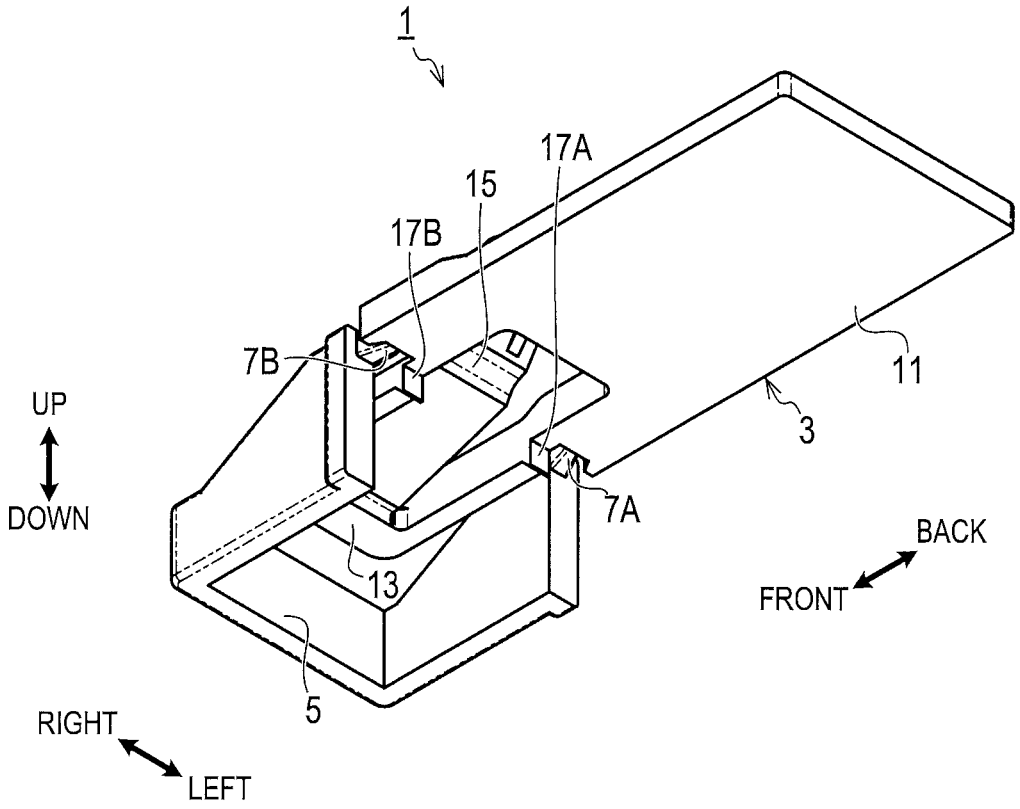
FIG. 1B is a perspective view of the connector fixture when viewed from the lower right rear.

The connector fixture described above will be described below according to exemplary embodiments. In the present embodiment, the description will be made using the front, back, left, right, top, and bottom directions illustrated in the drawings. These directions each are a relative direction. The direction in which portions of the connector fixture in the front view (see FIG. 3A) are oriented is defined as forward, the direction in which portions of the connector fixture in the rear view (see FIG. 3C) are oriented is defined as backward, the direction in which portions of the connector fixture in the left side view (FIG. 3B) are oriented is defined as leftward, the direction in which portions of the connector fixture in the right side view (not illustrated. The right side view and the left side view are symmetric) are oriented is defined as rightward, the direction in which portions of the connector fixture in the plan view (see FIG. 2A) are oriented is defined as upward, and the direction in which portions of the connector fixture in the bottom view (see FIG. 2B) are oriented is defined as downward.

However, it should be understood that these directions are defined only for the purpose of facilitating a simple description of the relative positional relationship of the constituents of the connector fixture. Therefore, for example, the direction in which the connector fixture is oriented in use is undefined. The left-right direction in the present embodiment corresponds to the x-axis direction in the present disclosure, the front-back direction in the present embodiment corresponds to the y-axis direction in the present disclosure, and the up-down direction in the present embodiment corresponds to the z-axis direction.

Configuration of Connector Fixture

As illustrated in FIGS. 1A, 1B, 2A, 2B, 3A, 3B, and 3C, the connector fixture 1 includes a fixture body 3 and a positioning member 5. The fixture body 3 and the positioning member 5 are coupled to each other via a first coupling portion 7A and a second coupling portion 7B (the first coupling portion 7A and the second coupling portion 7B correspond to an example of a connecting portion in the present disclosure). The portions constituting the connector fixture 1 are integrally molded of a resin material. The fixture body 3 includes a fixing portion 11, a support portion 13, a retaining portion 15, a first contact portion 17A, and a second contact portion 17B (the first contact portion 17A and the second contact portion 17B correspond to an example of a contact portion in the present disclosure).

Figure 4A:
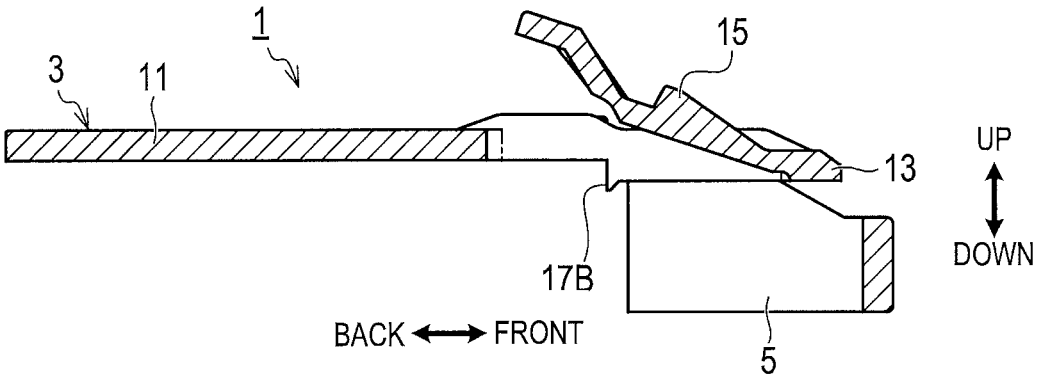
FIG. 4A is a cross-sectional view taken along a line IVA-IVA in FIG. 3A.
Figure 4B:
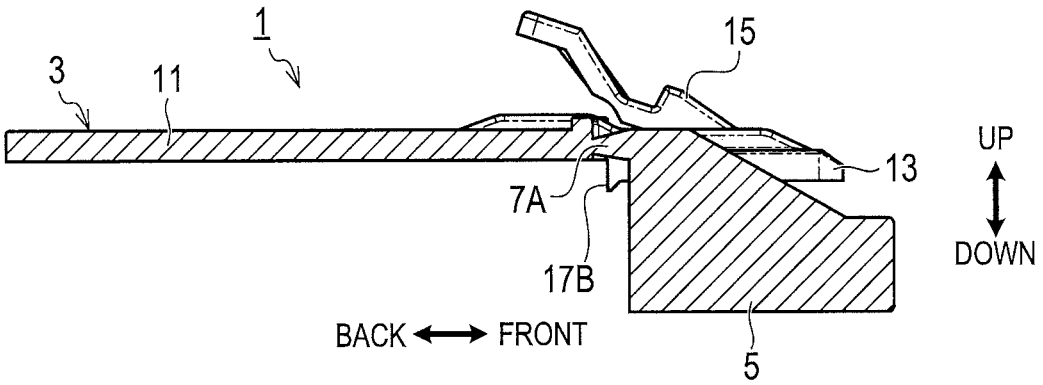
FIG. 4B is a cross-sectional view taken along a line IVB-IVB in FIG. 3A.

The fixing portion 11 is configured as a flat plate having a thickness in the up-down direction. The support portion 13 protrudes forward from a front end of the fixing portion 11. The first contact portion 17A and the second contact portion 17B are provided below the support portion 13. As illustrated in FIG. 4A, the retaining portion 15 extends obliquely upward and rearward from the vicinity of a front end of the support portion 13. The retaining portion 15 has a front end connected to the support portion 13 as a fixed end, and a rear end as a free end, and is supported such that the free end is swingable about the fixed end in the up-down direction.

Figure 2A:
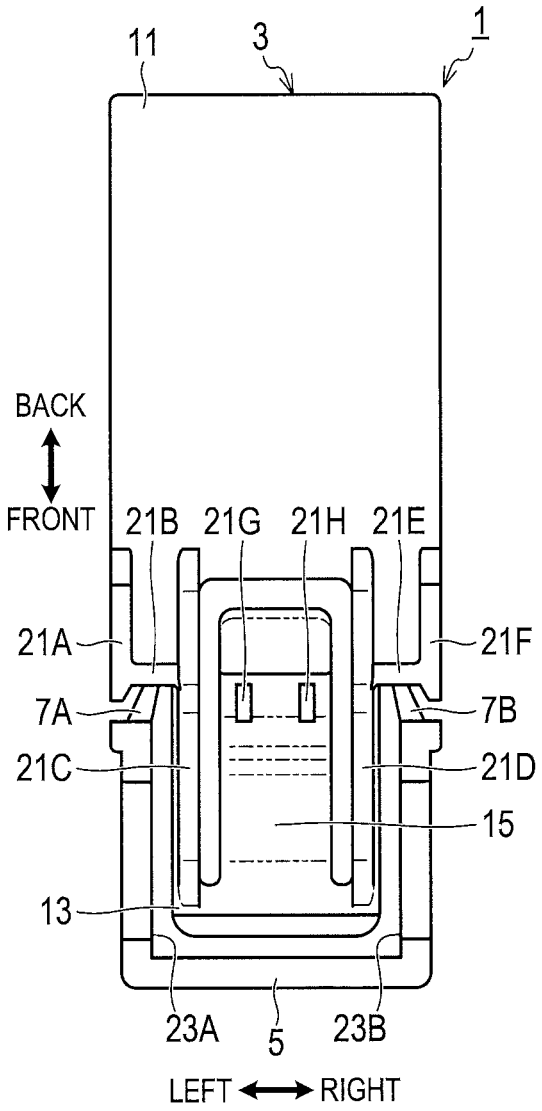
FIG. 2A is a plan view of the connector fixture.
Figure 2B:
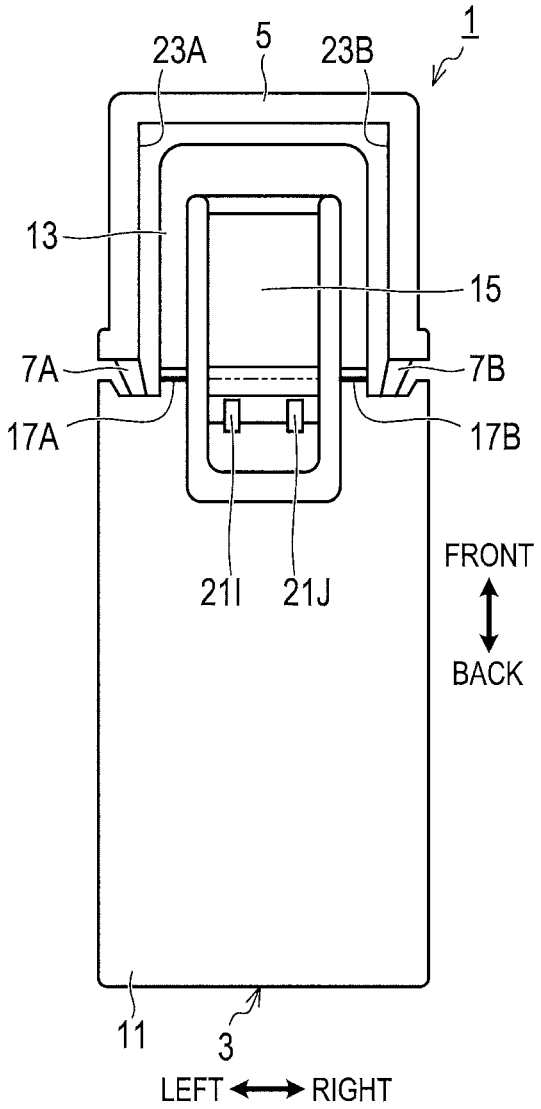
FIG. 2B is a bottom view of the connector fixture.
Figure 3A:
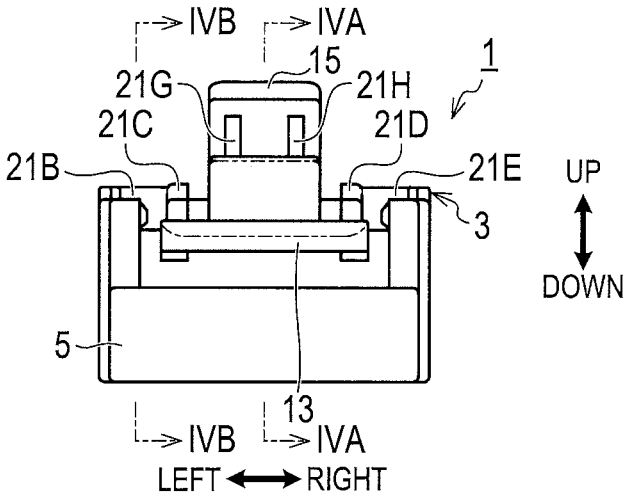
FIG. 3A is a front view of a connector fixture.
Figure 3B:
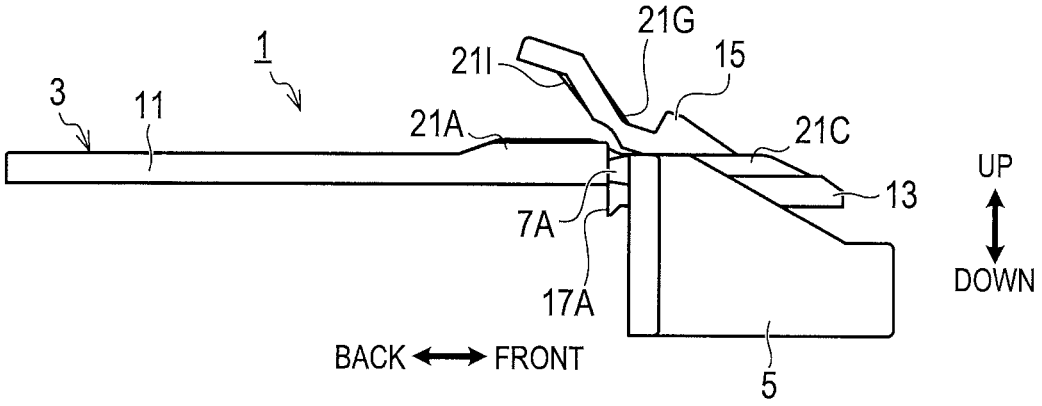
FIG. 3B is a left side view of the connector fixture.
Figure 3C:
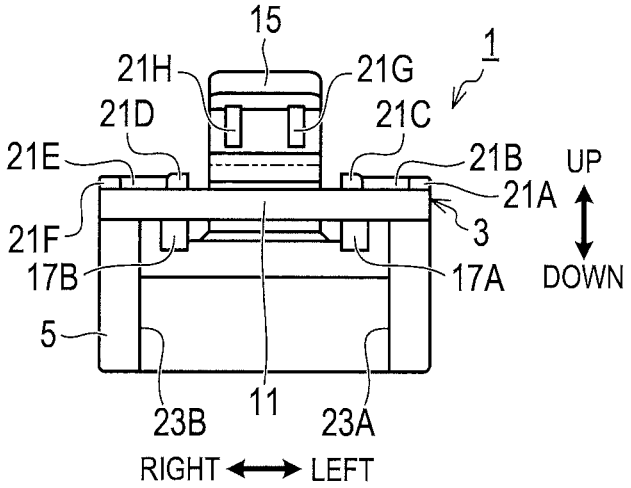
FIG. 3C is a rear view of the connector fixture.

As illustrated in FIGS. 2A, 3A, 3B, and 3C, ribs 21A, 21B, 21C, 21D, 21E, and 21F are provided above the fixing portion 11 and the support portion 13. As illustrated in FIGS. 2A, 3A, and 3B, ribs 21G and 21H are provided above the retaining portion 15. As illustrated in FIGS. 2B, 3B, and 3C, ribs 21I and 21J are provided below the retaining portion 15. These ribs 21A to 21J enhance the bending rigidity of the places where the ribs 21A to 21J are provided.

As illustrated in FIGS. 2A, 2B, and 3C, the positioning member 5 includes a first wall face 23A and a second wall face 23B, which are opposed to each other with a space therebetween in the left-right direction. As illustrated in FIGS. 2A, 2B, 3B, and 4B, the first coupling portion 7A and the second coupling portion 7B are tapered from one ends coupled to the positioning member 5 to the other ends coupled to the fixture body 3.

Figure 5A:
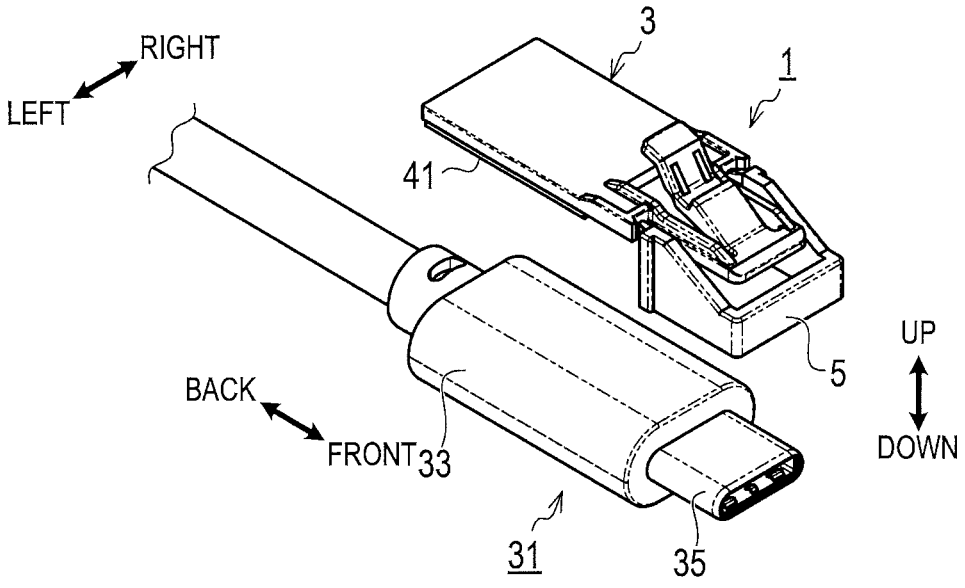
FIG. 5A is a perspective view illustrating a first connector and the connector fixture.
Figure 5B:
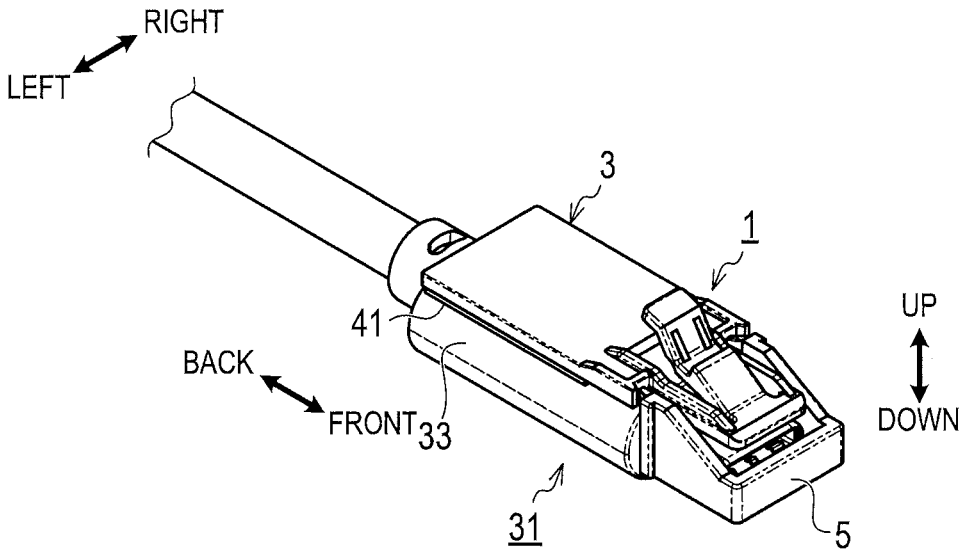
FIG. 5B is a perspective view illustrating a state where the connector fixture is attached to the first connector.
Figure 5C:
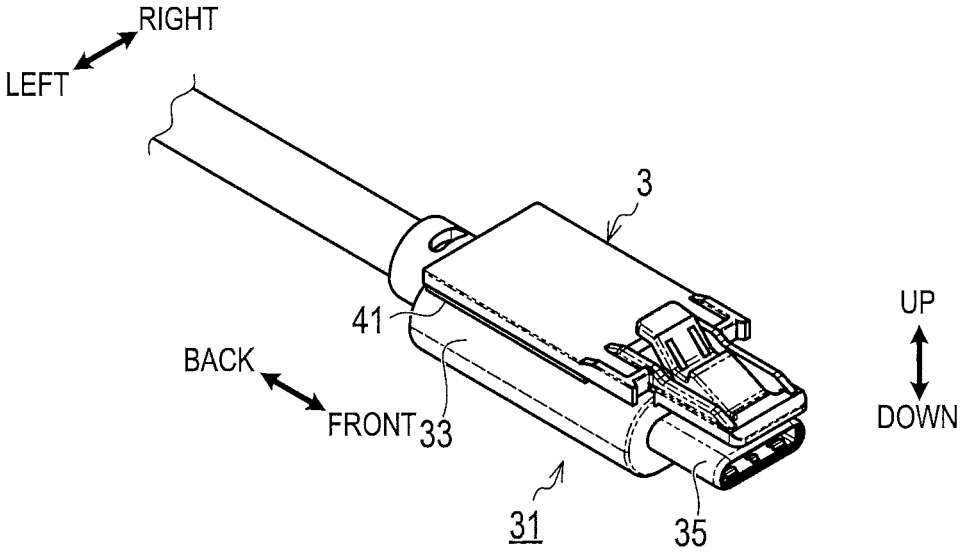
FIG. 5C is a perspective view illustrating a state where a positioning member is detached from the connector fixture attached to the first connector.

The connector fixture 1 thus configured is attached to a first connector 31 as illustrated in FIGS. 5A, 5B, and 5C. In the present embodiment, the first connector 31 is a plug connector conforming to Type-C of the USB (Universal Serial Bus). The first connector 31 includes a resin housing portion 33 and a metallic connecting portion 35 protruding from the housing portion 33.

When the connector fixture 1 is attached to the first connector 31, first, as illustrated in FIG. 5B, both the fixture body 3 and the positioning member 5 are attached to the first connector 31. At this time, the fixing portion 11 is fixed to the housing portion 33 of the first connector 31. In the present embodiment, a double-sided tape 41 is adhered to the fixing portion 11. The double-sided tape 41 can fix the fixing portion 11 to the housing portion 33 of the first connector 31.

Figure 6A:
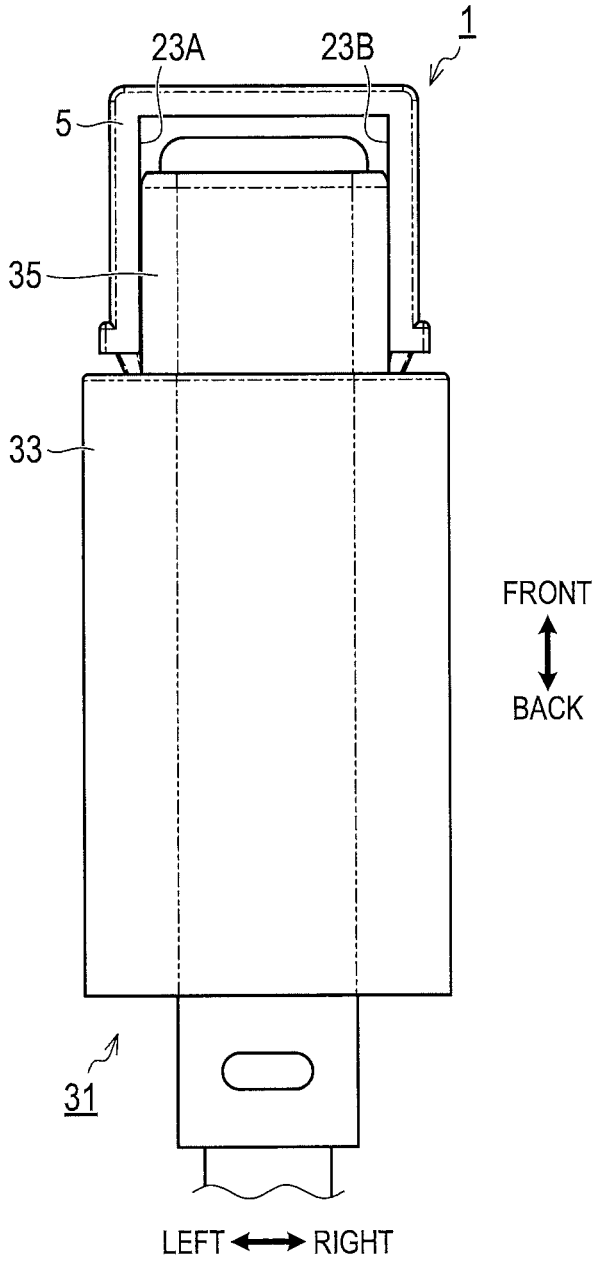
FIG. 6A is a bottom view illustrating a state where the positioning member of the connector fixture is in contact with a connecting portion of the first connector.

When the fixing portion 11 is fixed to the first connector 31, the relative position between the fixture body 3 and the first connector 31 is determined. Specifically, in the left-right direction, the relative position between the fixture body 3 and the first connector 31 is determined by fitting the connecting portion 35 of the first connector 31 into the positioning member 5 as illustrated in FIG. 6A. When the connecting portion 35 of the first connector 31 is fitted into the positioning member 5, in the state where the first wall face 23A and the second wall face 23B are disposed with a space therebetween in the direction that is parallel to the left-right direction, and the connecting portion 35 protrudes in the direction that is parallel to the front-back direction, both ends of the connecting portion 35 in the left-right direction are sandwiched between the first wall face 23A and the second wall face 23B.

The connecting portion 35 of the first connector 31 is shaped and dimensioned in conformity with the standard. Accordingly, unlike the housing portion 33 having indefinite shape and dimension, the connecting portion 35 can be tightly fitted between the first wall face 23A and the second wall face 23B of the positioning member 5. Further, since the connecting portion 35 of the first connector 31 is made of metal, the dimensional accuracy of the connecting portion 35 is higher than that of the resin housing portion 33. Therefore, the connecting portion 35 can be fitted into the positioning member 5, achieving positioning in the left-right direction with high accuracy.

Figure 6B:
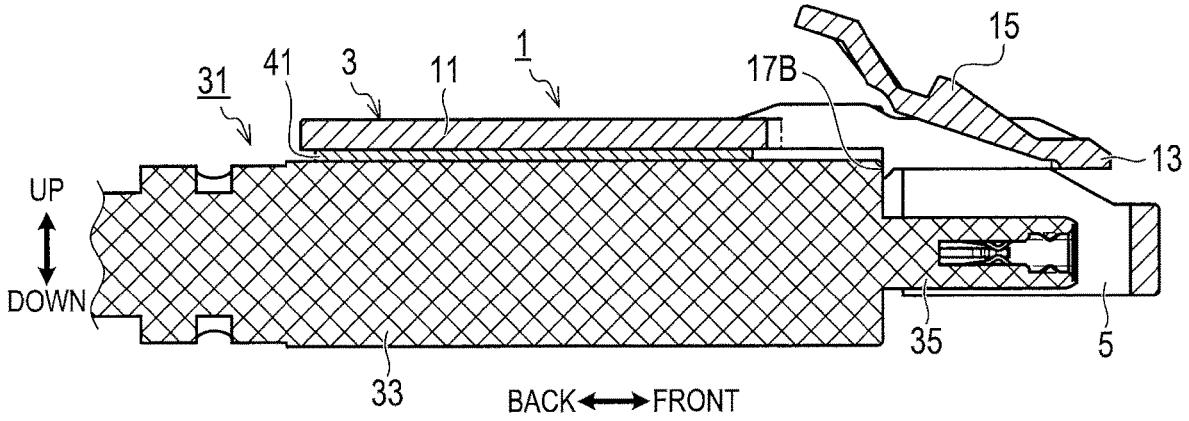
FIG. 6B is a longitudinal sectional view illustrating a state where a contact portion of the connector fixture is in contact with a housing portion of the first connector.

Further, in the front-back direction, the relative position between the fixture body 3 and the first connector 31 can be determined by causing a first contact portion 17A and the second contact portion 17B to contact the front end of the housing portion 33 (see FIG. 6B. However, FIG. 6B illustrates the second contact portion 17B). Once the relative position between the fixture body 3 and the first connector 31 is determined positioned in the left-right direction and the front-back direction as described above, by fixing the fixing portion 11 to the first connector 31 in this state, the relative position between the fixture body 3 and the first connector 31 can be determined by the fixing portion 11 in the up-down direction as well.

The connector fixture 1 is attached to the first connector 31 as described above, and then, the positioning member 5 is separated from the fixture body 3 to detach the positioning member 5. Thereby, as illustrated in FIG. 5C, only the fixture body 3 remains in the first connector 31. In the present embodiment, the positioning member 5 can be separated from the fixture body 3 by swinging the positioning member 5 to break the first coupling portion 7A and the second coupling portion 7B.

In more detail, in the present embodiment, as described above, the first coupling portion 7A and the second coupling portion 7B become the thinnest and weakest at the places coupled to the fixture body 3. In addition, the first coupling portion 7A and the second coupling portion 7B are disposed at two respective places that are spaced in the left-right direction. Therefore, when an external force is applied to the positioning member 5, the first coupling portion 7A and the second coupling portion 7B are bent at the weakest places, and as a result, the positioning member 5 swings about the axis that is parallel to the left-right direction.

Therefore, in a case where the positioning member 5 swings one or more times, a load is applied to the weakest places of the first coupling portion 7A and the second coupling portion 7B, breaking the first coupling portion 7A and the second coupling portion 7B at said places. Note that the connecting portion 35 of the first connector 31 is disposed between the first wall face 23A and the second wall face 23B of the positioning member 5, but the positioning member 5 swings about the axis that is parallel to the left-right direction and thus, the swinging of the positioning member 5 is not hindered by the connecting portion 35. Further, since the positioning member 5 is less likely to swing about the axis that is parallel to the up-down direction or the front-back direction, the positioning accuracy in the left-right direction can be improved.

Figure 7A:
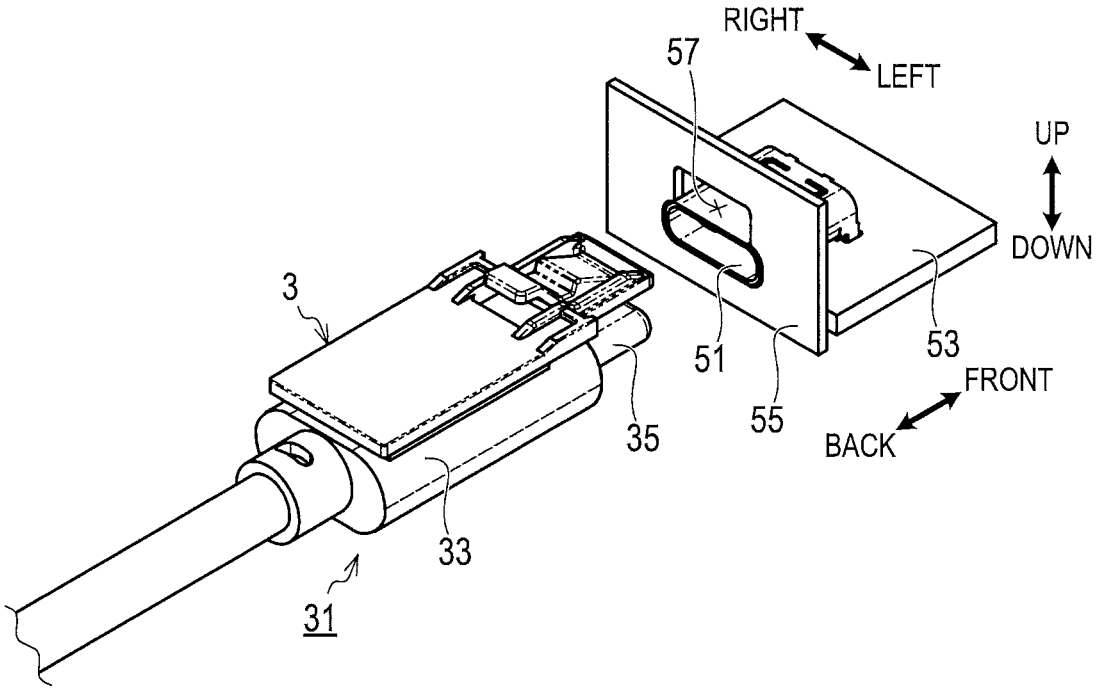
FIG. 7A is a perspective view illustrating a state before the first connector with the fixture body attached is connected to the second connector.
Figure 7B:
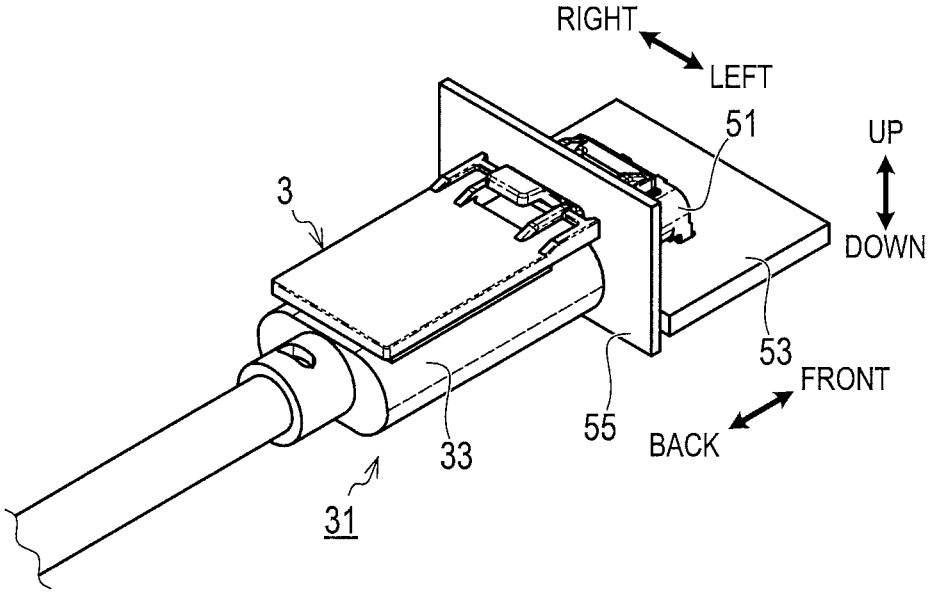
FIG. 7B is a perspective view illustrating a state after the first connector with the fixture body attached has been connected to the second connector.

As illustrated in FIGS. 7A and 7B, the first connector 31 with the fixture body 3 attached is connected to the second connector 51. In the present embodiment, a second connector 51 is a receptacle connector that conforms to Type-C of the USB. The second connector 51 is mounted on an electronic circuit board 53. The electronic circuit board 53 is disposed inside a panel 55 that constitutes the exterior of a device including the second connector 51. As illustrated in FIG. 7A, the panel 55 has an opening 57. The second connector 51 is fitted into a part of the opening 57.

Figure 8A:
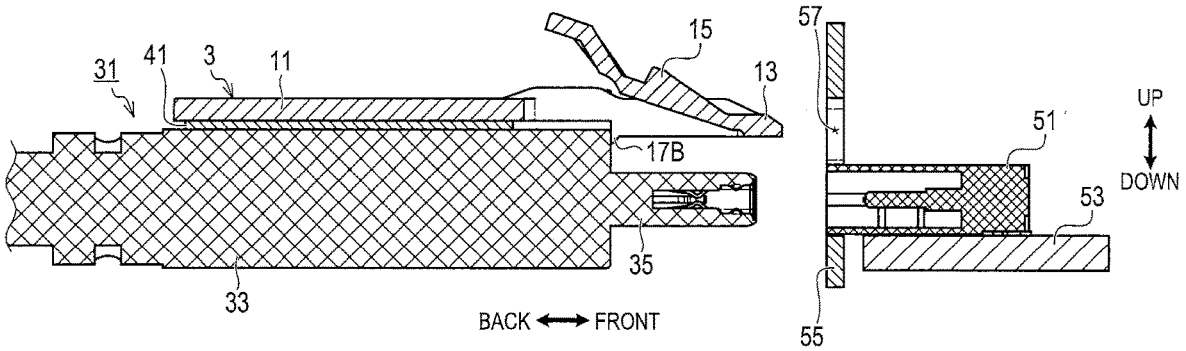
FIG. 8A is a longitudinal sectional view illustrating a state before the first connector with the fixture body attached is attached is connected to the second connector.
Figure 8B:
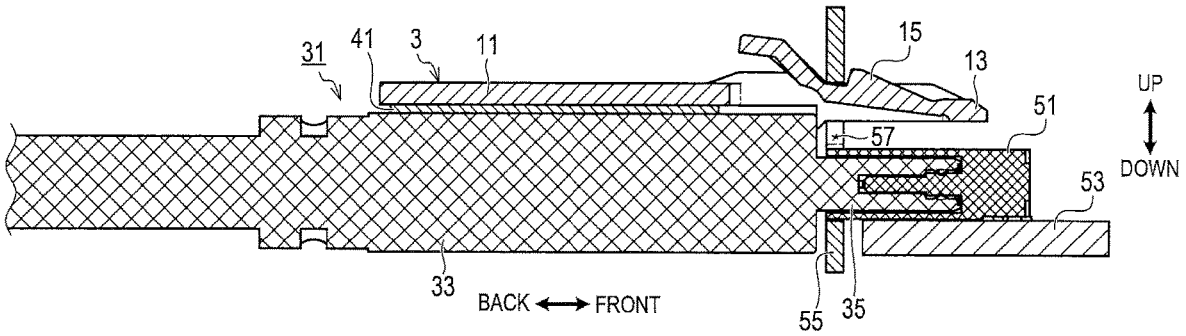
FIG. 8B is a perspective view illustrating a state after the first connector with the fixture body attached has been connected to the second connector.

In connecting the first connector 31 to the second connector 51, when the first connector 31 and the fixture body 3 move from a position illustrated in FIG. 8A to a position illustrated in FIG. 8B, a part of the fixture body 3 on the front end side enters into the panel 55 through the opening 57. At this time, the retaining portion 15 contacts with the panel 55 at the upper side of the opening 57 and elastically deforms. The part entered into the panel 55 is hooked on the inner side the panel 55. In this state, the retaining portion 15 prevents the first connector 31 from being displaced and detached from the second connector 51.

To detach the first connector 31 from the second connector 51, the free end (the rear end in the figure) of the retaining portion 15 is pressed downward in the figure. This can release the retaining portion 15 hooked on the panel 55, thereby pulling out the first connector 31 and the fixture body 3 from the position illustrated in FIG. 8B to the position illustrated in FIG. 8A.

Effects

As described above, in the connector fixture 1, the fixture body 3 can be attached to the first connector 31 by fixing the fixing portion 11 to the first connector 31. When the first connector 31 is connected to the second connector 51 in the state where the fixture body 3 is attached to the first connector 31, the retaining portion 15 is caught on the panel 55 of the device including the second connector 51, and prevents the first connector 31 from being displaced and detached from the second connector 51. Therefore, use of the fixture body 3 can prevent the first connector 31 from being detached from the second connector 51.

Further, when the fixture body 3 is attached to the first connector 31, the relative position between the fixture body 3 and the first connector 31 can be determined in the left-right direction by the positioning member 5, in the front-back direction by the first contact portion 17A and the second contact portion 17B, and in the up-down direction by the fixing portion 11. Accordingly, as compared with the case where positioning cannot be performed in any one or more of the left-right direction, the front-back direction, and the up-down direction, the fixture body 3 can be accurately positioned and attached to the first connector 31.

Furthermore, the positioning member 5 can be detached by separating the positioning member 5 from the fixture body 3 in the state where the fixing portion 11 is fixed to the first connector 31. Thus, as compared with the case where the positioning member 5 cannot be detached, the structure attached to the first connector 31 can be made compact. In addition, in a case where the positioning member 5 is detached, to connect the first connector 31 to the second connector 51, the positioning member 5 does not get in the way. Therefore, even the positioning member 5 that would become an obstacle when the first connector 31 is connected to the second connector 51 unless detached may be used without any problem.

Other Embodiments

The exemplary embodiment has been used to describe the connector fixture 1, but should not be construed to be any more than an example of one aspect of the present disclosure. In other words, the present disclosure is not limited to the exemplary embodiment described above and can be embodied in various forms without departing from the technical concept of the present disclosure.

For example, in the above-described embodiment, the fixing portion 11 is configured to be fixed to the first connector 31 with the double-sided tape 41. However, the fixing portion 11 may be configured to be fixed to the first connector 31 with fixing means other than the double-sided tape 41. For example, in place of the double-sided tape 41, an adhesive may be used. Alternatively, if the housing portion 33 of the first connector 31 can be designed specifically for the connector fixture 1, the fixing portion 11 and the housing portion 33 of the first connector 31 may be provided with mutually engageable engaging mechanisms.

Figure 9:
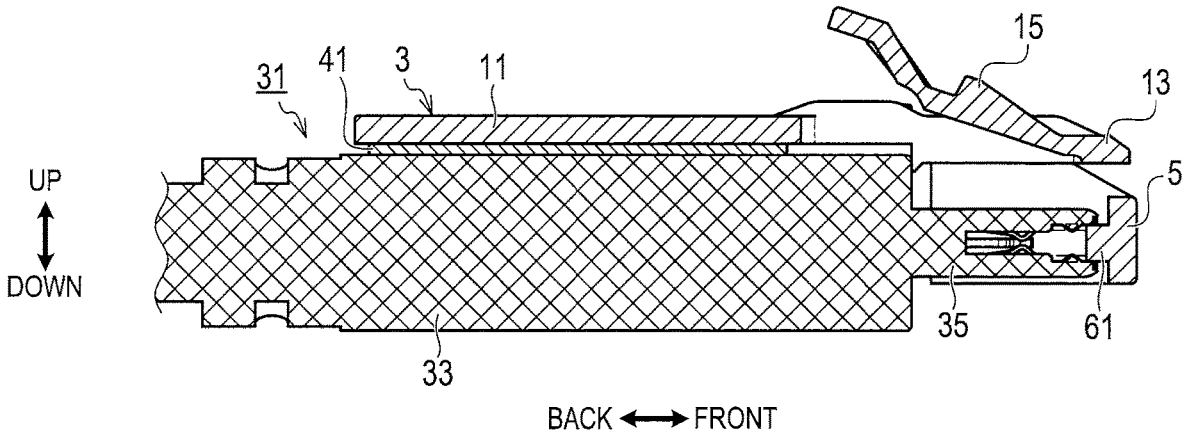
FIG. 9 is a longitudinal sectional view illustrating another example of the positioning member.

In the above embodiment, the fixture body 3 and the first connector 31 are positioned in the left-right direction by the positioning member 5 and however, may be also positioned in the up-down direction and the front-back direction by the positioning member 5. For example, as illustrated in FIG. 9, a convex portion 61 that fits into the connecting portion 35 of the first connector 31 can be provided on the positioning member 5, and the first fixture body 3 and the first connector 31 can be positioned in the up-down direction and the front-back direction by the convex portion 61.

Moreover, in the above-described embodiment, the first contact portion 17A and the second contact portion 17B are described as an example of the contact portion in the present disclosure. However, the number of the contact portion is not limited to two, and may be one or three or more.

In the above-described embodiment, the plug connector and the receptacle connector that conform to Type-C of the USB are exemplified as examples of the first connector and the second connector in the present disclosure. However, these connectors may be any other form of connector.

Note that a function realized by a single constituent element in each the above-described embodiments may instead be realized by a plurality of constituent elements. Additionally, a function realized by a plurality of constituent elements may instead be realized by a single constituent element. Parts of the configurations in the above-described embodiments may be omitted. At least part of the configuration of one of the above-described embodiments may be added to or replace the configuration of another of the above-described embodiments.

Supplementary Description

Note that, as clear from the exemplary embodiments described above, the connector fixture of the present disclosure may be further provided with configurations such as those given below.

In one aspect of the present disclosure, the first connector may include a housing portion and a metal connecting portion protruding from the housing portion, and when the connecting portion is connected to the second connector, the connecting portion may be inserted into the second connector.

The positioning member may be configured to contact the connecting portion when the fixture body is attached to the first connector, to determine relative position between the fixture body and the first connector in the x-axis direction.

In one aspect of the present disclosure, the positioning member may have two wall faces opposed to each other with a space therebetween, and in the state where the two wall faces are disposed with the space in the direction that is parallel to the x-axis direction and the connecting portion protrudes in the direction that is parallel to the y-axis direction, the positioning member is configured to sandwich both ends of the connecting portion in the x-axis direction between the two wall faces to determine relative position between the fixture body and the first connector in the x-axis direction.

In one aspect of the present disclosure, the positioning member may be configured to be swingably coupled to the fixture body via at least one coupling portion integrally molded with the fixture body and the positioning member using a resin material, to swing the positioning member to break the coupling portion, being separable from the fixture body.

In one aspect of the present disclosure, a first coupling portion and a second coupling portion may be provided as at least one coupling portion. The first coupling portion and the second coupling portion may be disposed with a space therebetween in the x-axis direction such that the swinging center of the positioning member is parallel to the x-axis direction.

What is claimed is:

1. A connector fixture comprising a fixture body and a positioning member, wherein the fixture body includes a fixing portion, a retaining portion, and a contact portion, the fixing portion is configured to be fixed to a first connector when the fixture body is attached to the first connector, and to determine relative position between the fixture body and the first connector in a z-axis direction among x-axis direction, y-axis direction, and z-axis direction, the directions being orthogonal to each other, when the fixing portion is fixed to the first connector, the retaining portion is configured to be hooked on a portion of a device including a second connector when the first connector is connected to the second connector in a state where the fixture body is attached to the first connector, preventing the first connector from being displaced and detached from the second connector, the contact portion is configured to contact the first connector when the fixture body is attached to the first connector, to determine relative position between the fixture body and the first connector in the y-axis direction, the positioning member is configured to contact the first connector when the fixture body is attached to the first connector, to determine relative position between the fixture body and the first connector in the x-axis direction, and the positioning member is configured to be separable from the fixture body, wherein the first connector has a housing portion and a metallic connecting portion protruding from the housing portion, the connecting portion being configured to be inserted into the second connector when the first connector is connected to the second connector, and the positioning member is configured to contact the connecting portion when the fixture body is attached to the first connector, and to determine relative position between the fixture body and the first connector in the x-axis direction.

2. The connector fixture according to claim 1, wherein the positioning member has two wall faces opposed to each other with a space, and in a state where the two wall faces are disposed with the space in a direction that is parallel to the x-axis direction and the connecting portion protrudes in a direction that is parallel to the y-axis direction, the positioning member is configured to sandwich both ends of the connecting portion in the x-axis direction between the two wall faces to determine relative position between the fixture body and the first connector in the x-axis direction.

3. The connector fixture according to claim 2, wherein the positioning member is configured to be swingably coupled to the fixture body via at least one coupling portion integrally molded with the fixture body and the positioning member using a resin material, and to swing the positioning member to break the coupling portion, being separable from the fixture body.

4. The connector fixture according to claim 3, wherein a first coupling portion and a second coupling portion are provided as the at least one coupling portion, and the first coupling portion and the second coupling portion are configured to be disposed with a space therebetween in the x-axis direction such that the swinging center of the positioning member is parallel to the x-axis direction.

* * * * *